US006196902B1

(12) United States Patent
Gazca-Ortiz et al.

(10) Patent No.: US 6,196,902 B1
(45) Date of Patent: Mar. 6, 2001

(54) APPARATUS FOR FINISHING THE EDGE OF A SHEET OF GLASS

(75) Inventors: Pedro Gazca-Ortiz; José Luis Jimenez-Garay, both of México; Rafael Rojas-Cortes, Atizapan de Zaragoza; Gonzalo Garcia-Perez, Izcalli; Raúl Perez-Gonzalez, México; José Rivera-Dominguez, Tultepec; Mauricio Rubio-Juarez, Atizapan de Zaragoza, all of (MX)

(73) Assignee: Vidrio Plano de Mexico, S.A. De C.V., Tlanepantla (MX)

( * ) Notice: Subject to any disclaimer, the term of this patent is extended or adjusted under 35 U.S.C. 154(b) by 0 days.

(21) Appl. No.: 09/560,834

(22) Filed: Apr. 28, 2000

(30) Foreign Application Priority Data

Apr. 29, 1999 (MX) ..... 993988

(51) Int. Cl.[7] ..... B24B 9/00

(52) U.S. Cl. ..... 451/242; 451/44; 451/178; 451/246; 451/450; 451/456

(58) Field of Search ..... 451/43, 44, 178, 451/182, 242, 246, 257, 444, 449, 450, 456, 451

(56) References Cited

U.S. PATENT DOCUMENTS 2,724,938 * 11/1955 James ..... 451/456
3,256,647 * 6/1966 Hutton ..... 451/450
4,426,811 1/1984 Eckardt et al. .
4,622,780 * 11/1986 Tingley ..... 451/450
4,769,954 9/1988 Hatas et al. .
5,265,382 * 11/1993 Park ..... 451/44
5,410,843 * 5/1995 Gottschald ..... 451/43
5,944,584 * 8/1999 Toyama ..... 451/43

* cited by examiner

*Primary Examiner*—Eileen P. Morgan
(74) *Attorney, Agent, or Firm*—Abelman, Frayne & Schwab

(57) ABSTRACT

An apparatus for finishing the edge of a sheet of glass, which includes a supporting structure with a support base, a stationary vertical structure coupled on the support base, and, an upper supporting arm located in a horizontal position on the vertical stationary structure. A motor is connected at one end of the upper supporting arm. Grinding means are connected to the motor fort finishing or grinding the edge of sheet of glass. A housing for housing the grinding means, which includes a fixed upper section and a removable lower section. A longitudinal groove is made in the housing for the introduction of the edge of the glass sheet to contact with the grinding means in order to finish the edge of the glass sheet. Cooling means are located within the housing for cooling the periphery, lower and upper sections of the grinding means during the finishing of the edge of the glass sheet. Vacuum means are connected to the housing to provoke a vacuum effect within the housing for recollecting glass dust and water that is being generating within the housing during the finishing operation of the edge of the glass sheet.

9 Claims, 4 Drawing Sheets

APPARATUS FOR FINISHING THE EDGE OF A SHEET OF GLASS

FIELD OF THE INVENTION

The present invention refers to an apparatus for finishing the edge of a sheet of glass, and more specifically, to an apparatus for finishing the edge of a sheet of glass, particularly for automotive glass windows, which helps to cool the polishing grindstone and at the same time by a vacuum effect, remove the glass and glass dust that have been ground during the polishing process.

BACKGROUND OF THE INVENTION

It is well known that sheets of glass, for example, glass for the automotive industry, mirrors, etc. have been cut in keeping with the desired shape, which therefore has to have its edges polished, both for eliminating any possible burrs as well for removing small peripheral fractures that might cause the glass to shatter during the next process that it will be subjected to such as tempering, bending, etc.

Regularly, the edges of the sheets of glass are subjected to a process known as "machining the edge with polishing", which consists of passing a fine grain polisher or a diamond wheel through the length of the edge of the sheet or glass plate several times. The edge of the sheet has to be maintained humid in order to cool the grinding stone, as well as to prevent the raising of glass dust during the grinding or polishing of the sheet.

In order to maintain the grinding or polishing stone wet, it is necessary that there be a continuous flow of water to cool the grinding or polishing wheel. However, the main problem resides in that with this type of grinders, the flow of water drains over the edge of the sheet of glass, staining it with all of the dust that has been ground off.

Another problem that presents itself in the grinding or polishing used for sheets of glass is that on some occasions the water does not fall directly onto the grindstone, thus provoking the edge of the sheet of glass to get burnt.

In order to resolve the above, after the sheets of glass have been polished, an operator has to clean them in order to remove any residual that may be left after the polishing operation. However, in some cases, the sheet of glass had already been damaged (by spots or burnt places), and because of this it has to be discarded because it does not comply with the quality standards that are required by the automotive industry.

At present there are already polishing machines for polishing the edge of a sheet of glass, for example, U.S. Pat. No. 4,426,811, of Rudolf Eckardt et al, which refers to a method of grinding glass sheets whose edges are polygons that are not symmetrical about a point. The method is carried out by using an apparatus having a supply station for supporting a stack of sheets in a vertical registration, a grinding station adjacent to the supply station having a grinding table rotatable about an upright grinding axis and adapted to support the sheets of glass during grinding, a template secured to the grinding table, and a pair of grinders in the grinding station radially engageable with the edges of the sheet on its grinding table and radially displaceable by the template. The method of the invention comprises the steps of transporting the sheets, one at a time from the stack in the supply station to the grinding station, simultaneously engaging the grinders with the sheet in the grinding station, while rotating this grinding table with its template and the sheet on the table through a 180° to grind the edges of the sheet on the table, so that each such grinding operation displaces the template through 180° about the axis. Finally, every other sheet is rotated while being transported from the supply station to the grinding station through 180° about an intermediate vertical axis.

The U.S. Pat. No. 4,769,954 of Peter J. Hatas et al, refers to an apparatus for supporting and positioning a planar glass workpiece within a glass grinding apparatus. Three radially extended carriage assemblies are provided between a lower pan and an upper supporting platform. Each one of the carriage assembly extends radially outwardly from a central drive shaft connected to the supporting platform to the periphery of the lower pan. The radial inner ends of the carriage assemblies are rotatably supported about the drive shaft, while the radial outer ends are carried on respective motor assemblies connected to a gear formed on a lower pan. Energization of the motor assemblies causes the associated carriage assemblies to pivot relative to the lower pan. Each one of the carriage assemblies also carries a locator cylinder assembly thereon. The locator cylinder assemblies are movable radially, inwardly and outwardly throughout the length of the corresponding carriage assemblies by means of the associated motor assemblies. Each of the locator cylinder assemblies includes a locator button assembly. Each one of locator buttom assemblies is selectively movable between an extended position and a retracted position. A computer controls the operation of all of the motor assemblies so as to angularly position each of the carriage assemblies and to radially position each of the locator cylinder assemblies, all in accordance with predetermined stored data relating to the particular shape of the glass workpiece.

Notwithstanding the above, the present invention also is referred to an apparatus for finishing the edge of a sheet of glass, which is used to lubricate a grinding wheel and, simultaneously, collect the glass dust produced by the finishing operation on the edge of the glass sheet.

The apparatus for finishing the edge of a glass sheet is of the type that comprises a support structure, which includes a support base, a stationary vertical structure that is supported over the support base, and a supporting upper arm located in a horizontal position on the stationary vertical structure; a motor provided in a fixed manner at an end of the free supporting upper arm, said motor including a drive shaft supported in a vertical position for rotating over its own axis by the movement of the motor; a grinding wheel or a diamond wheel connected to the drive shaft to finish the edge of a glass sheet; and a tubular structure connected to the motor structure, which is positioned vertically in order to cover the drive shaft, the improvements are characterized by: a hollow housing for housing of the grinding wheel, said housing including: a first fixed section connected to the lower edge of the tubular structure, and a lower removable section, said lower removable section being meshed with the first fixed section through first a pivoting movement towards a closing position with respect to the first fixed section, and, for permitting the removal of said lower section when it is pivoted in an inverse position, a lateral slot in the lower removable section, for permitting the entry of the edge of the sheet of glass so as to make contact with the grinding wheel. A pair of continuous tubes for the distribution of a cooling fluid, which are placed by the internal periphery of the lower section of the housing for feeding the cooling fluid in the form of a mist, towards the edge and the upper and lower part of the grinding wheel. Means to cause a vacuum effect within the housing, for collecting a mixture of glass dust and water that is being generated within the housing during the finishing operation of the edge of the sheet of glass.

OBJECTIVES OF THE INVENTION

A first objective of the present invention is to provide an apparatus for finishing the edge of a sheet of glass, which prevents its being stained with the very dust that has been ground off.

An additional objective of the present invention is to provide an apparatus for finishing the edge of a sheet of glass that avoids the dissemination of glass dust during the grinding or finishing of the glass sheet.

An additional objective of the present invention is to provide an apparatus for finishing the edge of a sheet of glass, which collects glass dust mixed with water, through the application of a vacuum effect.

These and other objectives and additional advantages of the present invention will be evident to those persons who are experts in the field of the following detailed description of the invention, which will be made with reference to a specific embodiment of it in an illustrative sense but not one that would limit the invention.

DETAILED DESCRIPTION OF THE INVENTION

Figure 1:
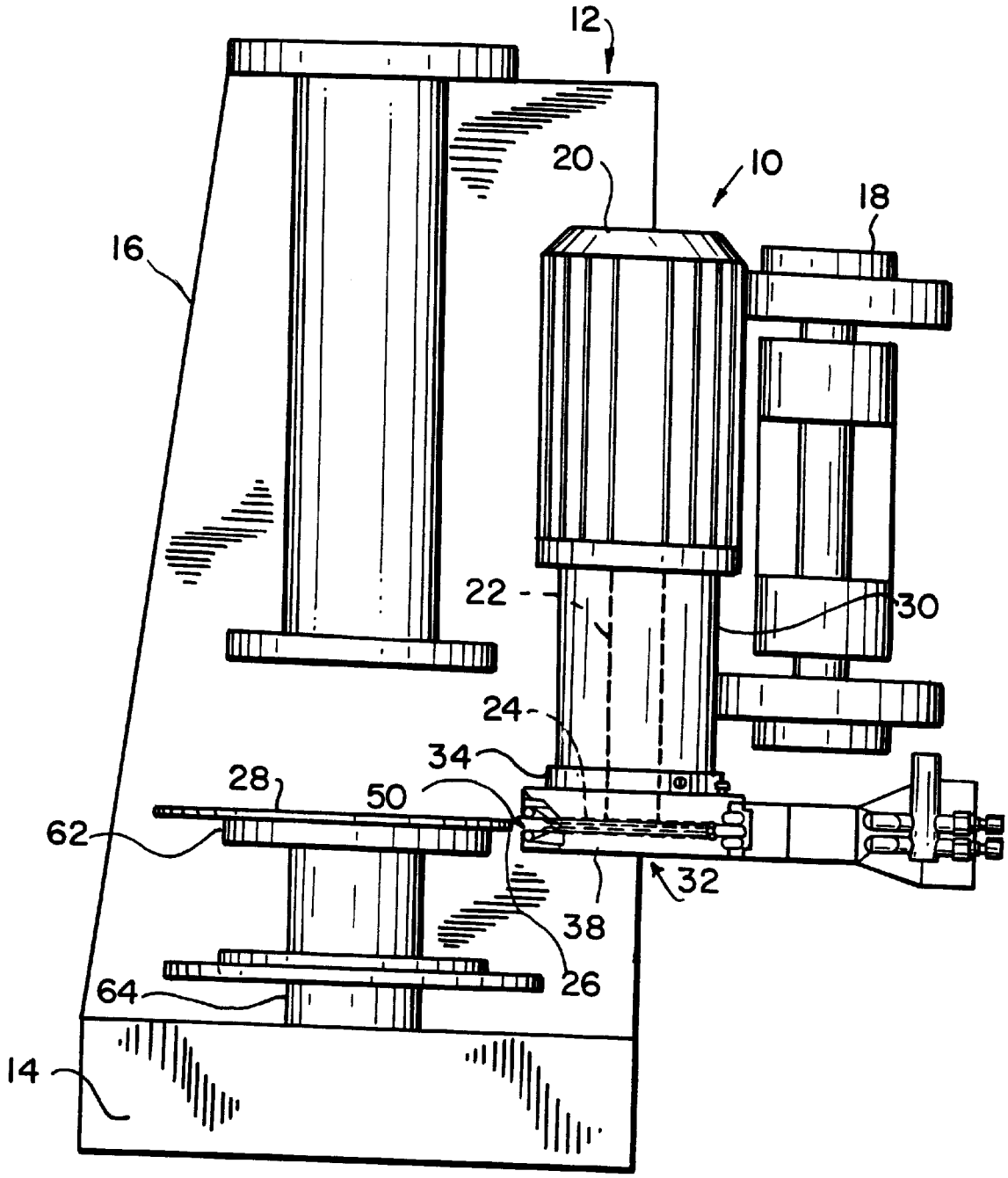
FIG. 1 is a lateral view that shows, in a schematic manner, an apparatus for finishing a sheet of glass in accordance with the present invention.

Now follows a reference to a specific embodiment of the present invention that is illustrated in the figures which are attached and where the same numbers refer to the same parts and wherein FIG. 1 is a lateral view that shows, in a schematic manner an apparatus 10 for finishing a sheet of glass 28. The apparatus 10 including a support structure 12, which includes a support base 14, a stationary vertical structure 16, coupled on the support base 14, and an upper supporting arm 18, located in a horizontal position on the vertical stationary structure 16. A motor 20 is connected at one end of the free supporting arm 18. The motor 20 including an drive shaft 22, located in a vertical position to rotate over its own axis by the movement of the motor 20. The drive shaft 22 is connected with a grinding disc 24, on its lower part, for finishing or grinding the glass edge 28. A tubular structure 30 is connected to the motor structure 20, which is vertically positioned for covering the drive shaft 22.

Figure 2:
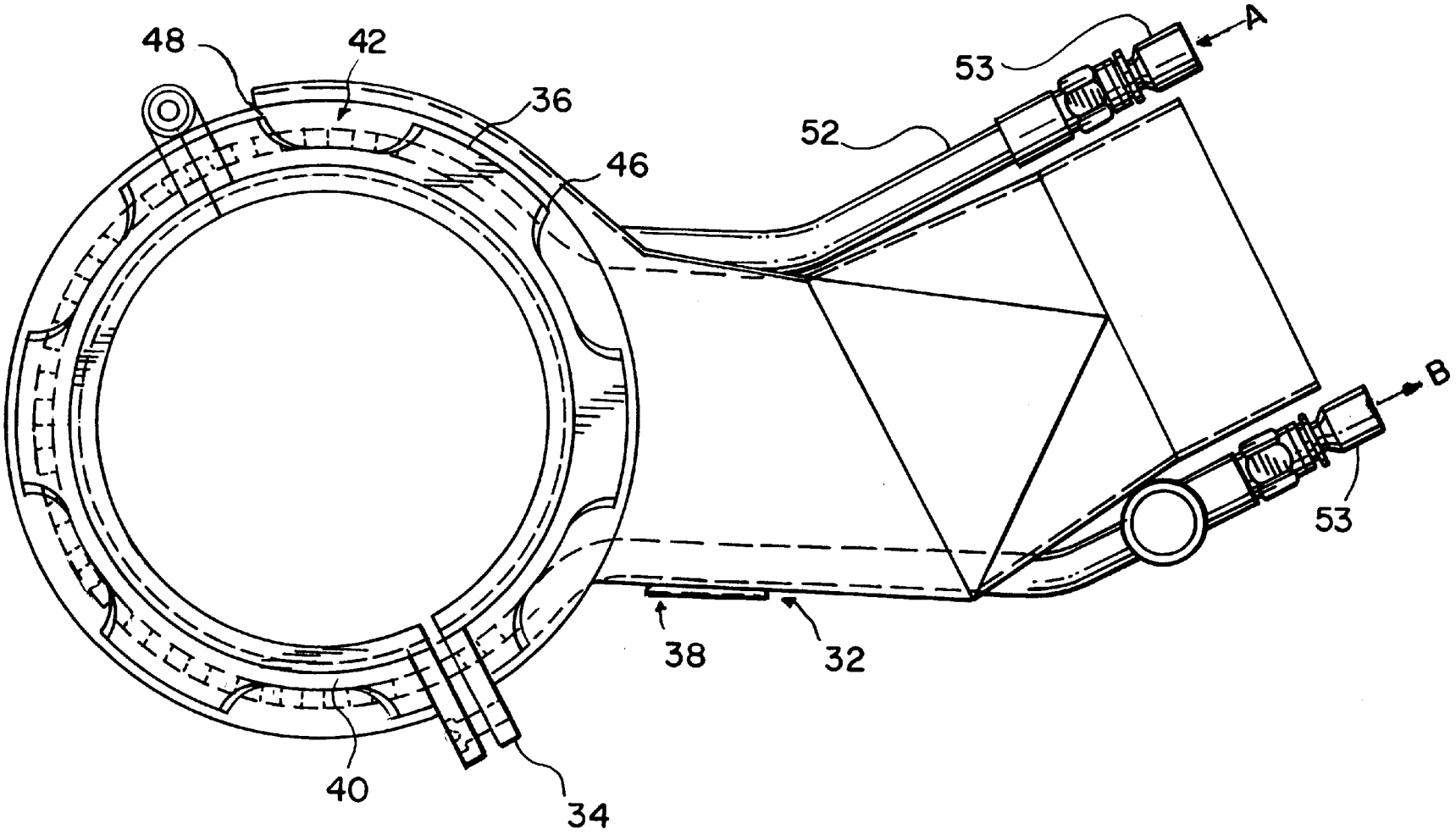
FIG. 2 is an upper view that shows a housing that contains a grinding wheel for finishing a sheet of glass.
Figure 3:
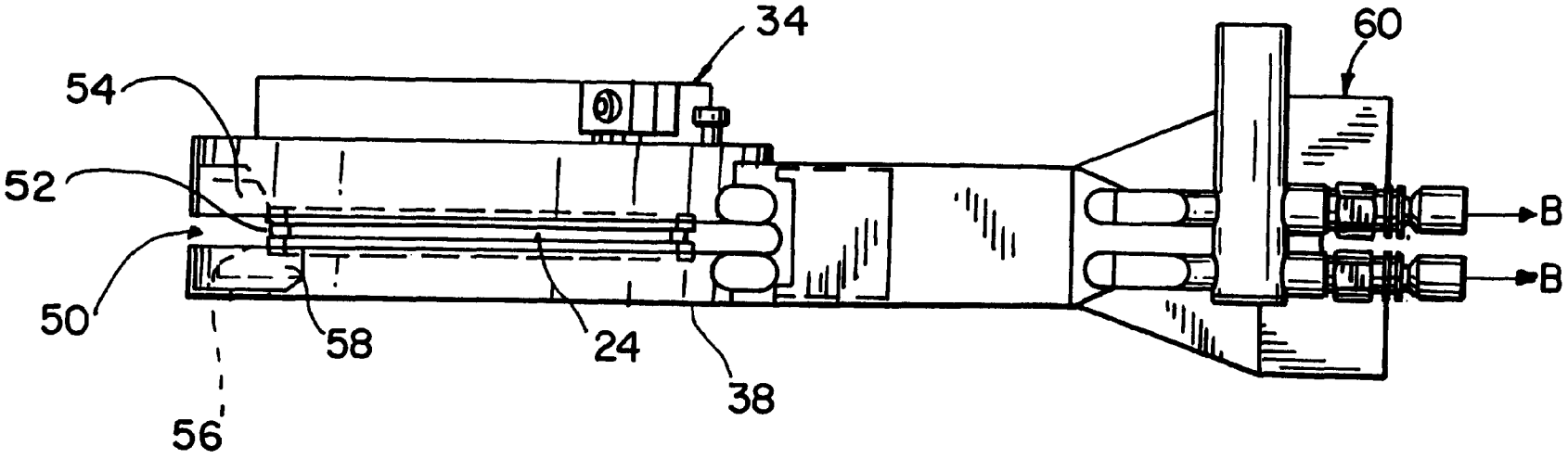
FIG. 3 is a lateral view that shows a housing that is illustrated ion FIG. 2.
Figure 4:
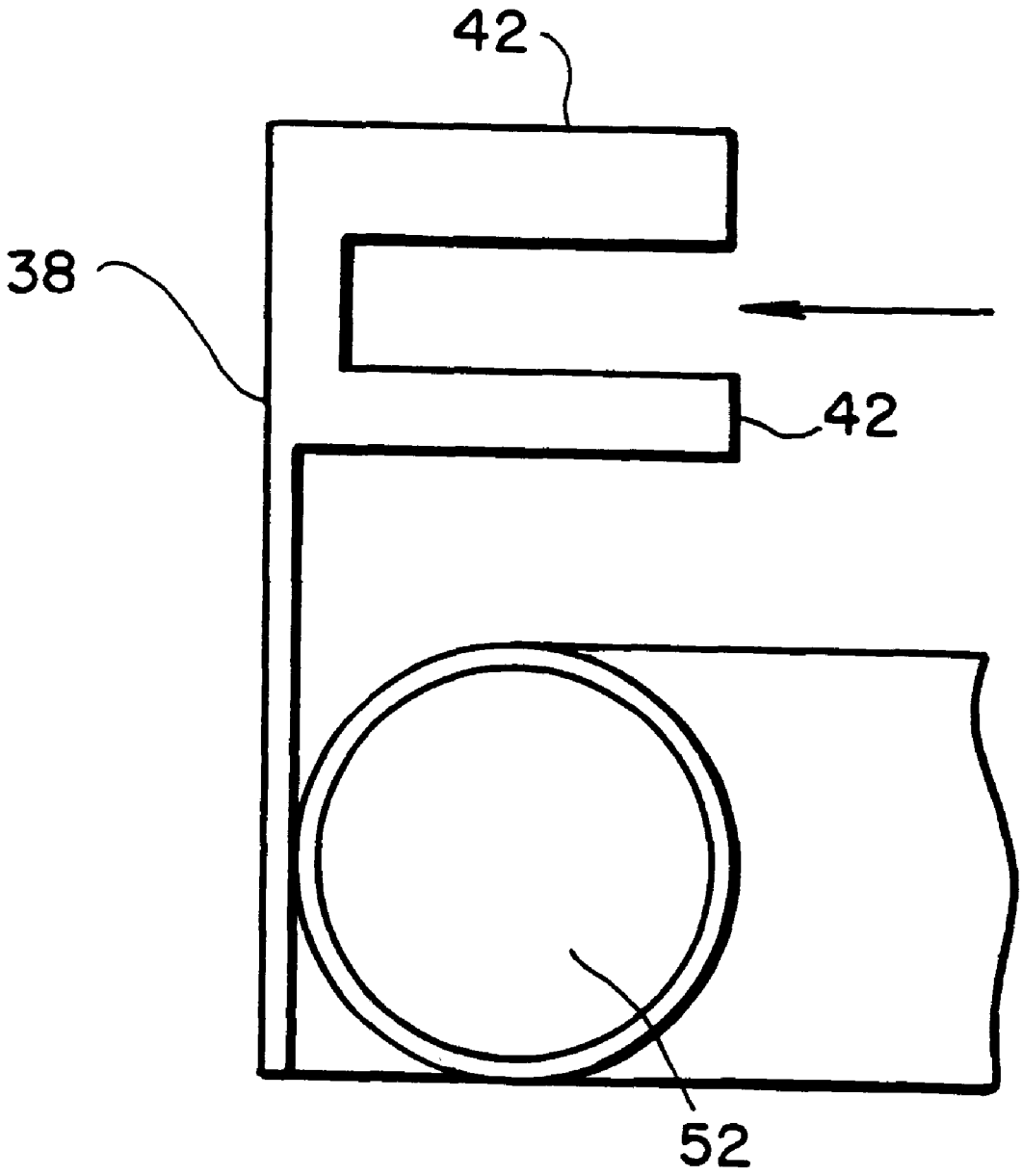
FIG. 4 is a detailed view taken of FIG. 3.

A hollow housing 32 (FIGS. 1 and 2) for housing the grinding disc 24, which comprises an upper fixed circular section 34, which is attached to the lower end of the tubular structure 30. The circular upper section 34, including a plurality of annular flanges 36 that are separated around the outer periphery of said circular upper section 34; and a lower section 38, that includes a circular upper wall 40, and a plurality of annular flanges 42 (FIGS. 2 and 3A) that are spaced around the outer periphery of said lower section 38, over the upper circular wall 40, thus forming a circular channel 44 having upper entry spaces 46, (FIG. 3A) around of said lower section 38.

In this manner, the lower section 38 can be connected to the upper section 34, through the coincidence of the annular flanges 36 of the upper section 34, with the entry spaces 46, left in the lower section 38, and those of the annular flanges 42, with the entry spaces 48, left in the upper section 34. So, the lower section 38 is connected with its respective annular flanges 42, through 6 first pivoting movement towards a closing position with respect to the upper section 34, and, with a second pivoting movement for permitting the removal of the lower section 38, when said lower section 38 is pivoted in an opposite position.

The lower section 38, of the housing 32, comprising a longitudinal groove 50, horizontally located with respect to the lower section (FIG. 3) for the collocation of the edge 26, of the glass sheet 38.

In addition to the above, the lower section 38 of the housing 32 also includes a first continuous tube 52 for the distribution of a cooling liquid. The first continuous tube 52 is located on the internal upper part of the lower section, 38, over the longitudinal groove 50. The first tube 52, having a plurality of holes 54, which are oriented to coincide with the upper part of the grinding disc 24, to project cooling fluid in a spray way towards the edge and the upper part of the grinding disc 24, for its cooling. The tube 52 can be connected through threaded couplings 53 to a continuous water source (with an entry A and an exit B), for the cooling of the grinding disc 24.

A second continuous tube 56, for the distribution of a cooling fluid is located on the lower internal edge of the lower section 38, of the hollow housing 32. The second continuous tube 56, having a plurality of orifices 58, which are oriented to coincide with the lower edge of the grinding wheel 24, placed over the lower part of the groove 50, in order to project cooling fluid in the form of a spray towards the edge and lower part of the grinding disc 24, for its cooling.

The housing 32, furthermore including a duct with a rectangular section 60, in its back part, through which a vacuum effect is carried out, in order to collect a mixture of glass dust and water that is being generated within the housing 32, during the finishing or grinding operation of the edge 26, of the glass sheet 28. The glass dust and water are recollected in a tank (not shown) to deposit the glass dust and for recycling the water.

The apparatus for finishing or grinding the edge of a glass sheet 28, is used in combination with a rotatable work table 62. The edge 26 of the glass sheet 28, overextends the edge of the rotatable work table 62, and is placed towards and coinciding with the grinding wheel 24, of the apparatus 10, of the present invention. The rotatable work table 62, rotates on its own rotatable axis through a shaft 64, operated by a motor (not shown). In this way, when the grinding wheel 24 makes contact with the edge of the glass sheet 28, a grinding or finishing operation for finish the edge 26 of the glass sheet is carried out.

As can be seen from the embodiment above described, an apparatus for finishing or grinding the edge of a sheet of glass is used to prevents the spotted with same the dust that has been grounded. However, it must be understood that the invention should not be limited to the embodiment above described, and it will be apparent to the experts in the field that other diverse embodiments could be implemented, along with alternative embodiments which will be clearly contained within the spirit of the present invention which are claimed in the following claims.

We claim:

1. Apparatus for finishing an edge of a sheet of glass, which comprises: a supporting structure, said supporting structure including a support base, a stationary vertical structure coupled on the support base, and, an upper supporting arm located in a horizontal position on the vertical stationary structure; a motor connected at one end of the upper supporting arm, said motor including a drive shaft located in a vertical position to rotate about its own axis, grinding means connected to the drive shaft for finishing or grinding the edge of sheet of glass; and a hollow frame connected to the motor, said hollow frame being vertically located for covering the drive shaft; a housing for housing the grinding means, said housing comprising a fixed upper section connected to a lower end of the hollow frame and, a removable lower section; a longitudinal groove is made in the housing for the introduction of the edge of the glass sheet for making contact with the grinding means in order to finish the edge of the glass sheet; means for distributing a cooling fluid located within the housing, for distributing the cooling fluid on the periphery and one lower and upper sections of said grinding means, for grinding or finishing the edge of the glass sheet; and, vacuum means operatively connected to the housing to create a vacuum effect within said housing for recollecting glass dust and water that is generated within the housing during the finishing operation of the edge of the glass sheet.

2. Apparatus for finishing the edge of a sheet of glass as claimed in claim 1, wherein the removable lower section of said housing is connected with the fixed upper section by means of a first pivoting movement toward a closing position with respect to said fixed upper section, said removable lower section being removable with a second pivoting movement when said lower section is moved in an opposite position.

3. Apparatus for finishing the edge of a sheet of glass as claimed in claim 1, wherein the fixed upper section of the housing comprises: first annular flanges which are spaced around the outer periphery of said fixed upper section.

4. Apparatus for finishing the edge of a sheet of glass as claimed in claim 1, wherein the removable lower section of the housing comprises: a circular upper wall with plurality of annular flanges spaced around the periphery of said removable lower section, at atop of the circular upper wall forming a channel with upper entry spaces around the periphery of said removable lower section.

5. Apparatus for finishing the edge of a sheet of glass as claimed in claim 1, wherein the means for distributing a cooling fluid comprises, a first continuous tube for distributing the cooling fluid, said first tube being located on an upper internal part of the longitudinal groove, said first tube having a plurality of holes projected toward the upper section of the grinding means for projecting the cooling fluid towards the periphery and upper section of the grinding means.

6. Apparatus for finishing the edge of a sheet of glass as claimed in claim 5, wherein the means for distributing a cooling fluid further comprises, a second continuous tube for distributing the cooling fluid, said second tube being located on a lower internal part of the longitudinal groove, said second continuous tube having a plurality of holes projected toward the lower section of the grinding means for projecting the cooling fluid towards the periphery and lower section of the grinding means.

7. Apparatus for finishing the edge of a sheet of glass as claimed in claim 1, wherein the cooling fluid is water.

8. Apparatus for finishing the edge of a sheet of glass as claimed in claim 1, wherein the vacuum means comprises: a rear duct, said rear duct being used to carried out a vacuum effect within the housing, for collecting a mixture of glass dust and water that is being generated within the housing at the moment that the edge of the glass sheet is being finished.

9. Apparatus for finishing the edge of a sheet of glass as claimed in claim 1, wherein the means for distributing a cooling fluid projects the cooling fluid in a spraying manner.

* * * * *